US009476274B2

(12) United States Patent
Edmonstone et al.

(10) Patent No.: US 9,476,274 B2
(45) Date of Patent: Oct. 25, 2016

(54) APPARATUS AND SYSTEM AND METHOD OF MEASURING DATA IN A WELL EXTENDING BELOW SURFACE

(75) Inventors: Graham Edmonstone, Copenhagen O (DK); Pieter Karel Anton Kapteijn, Hellerup (DK)

(73) Assignee: MAERSK OLIE OG GAS A/S, Copenhagen K (DK)

( * ) Notice: Subject to any disclaimer, the term of this patent is extended or adjusted under 35 U.S.C. 154(b) by 1036 days.

(21) Appl. No.: 13/511,881

(22) PCT Filed: Nov. 23, 2010

(86) PCT No.: PCT/EP2010/068035

§ 371 (c)(1),
(2), (4) Date: Oct. 3, 2012

(87) PCT Pub. No.: WO2011/064210

PCT Pub. Date: Jun. 3, 2011

(65) Prior Publication Data

US 2013/0025852 A1 Jan. 31, 2013

Related U.S. Application Data

(60) Provisional application No. 61/263,986, filed on Nov. 24, 2009.

(30) Foreign Application Priority Data

Nov. 24, 2009 (DK) ..... 2009 70223

(51) Int. Cl.
*E21B 23/14* (2006.01)
*E21B 23/10* (2006.01)

(Continued)

(52) U.S. Cl.
CPC ..... *E21B 23/14* (2013.01); *E21B 23/10* (2013.01); *E21B 44/005* (2013.01); *E21B 2023/008* (2013.01)

(58) Field of Classification Search
CPC .. E21B 2023/008; E21B 23/14; E21B 47/00; E21B 47/12; E21B 47/123; E21B 44/00
See application file for complete search history.

(56) References Cited

U.S. PATENT DOCUMENTS 4,676,310 A * 6/1987 Scherbatskoy et al. ... 340/853.4
4,848,734 A 7/1989 Ford (Continued)

FOREIGN PATENT DOCUMENTS

WO WO 93/18277 A1 9/1993
WO 03089760 A1 10/2003

(Continued)

OTHER PUBLICATIONS

International Search Report for PCT:EP2010:068035, mailed Mar. 16, 2012.

(Continued)

*Primary Examiner* — William P Neuder
*Assistant Examiner* — Tara Schimpf
(74) *Attorney, Agent, or Firm* — Brinks Gilson & Lione

(57) ABSTRACT

The present invention relates to a system for measuring data in a well extending below surface, said system comprising a body having a longitudinal axis and a front end and a rear end; locomotion means; control means adapted to control direction and/or speed of the locomotion means; said control means being controllable from the surface. Thereby is achieved that a body may be remotely controlled from the surface e.g. the entrance of an oil well.

18 Claims, 4 Drawing Sheets

(51) Int. Cl.
*E21B 44/00* (2006.01)
*E21B 23/00* (2006.01)

(56) References Cited

U.S. PATENT DOCUMENTS

| | | | | |
|---|---|---|---|---|
| 5,209,304 | A | 5/1993 | Nice | |
| 5,570,437 | A | 10/1996 | Kluth | |
| 6,112,809 | A | 9/2000 | Angle | |
| 6,173,787 | B1 * | 1/2001 | Wittrisch | 166/384 |
| 7,219,730 | B2 | 5/2007 | Tilton | |
| 7,322,421 | B2 | 1/2008 | Blacklaw | |
| 7,409,858 | B2 | 8/2008 | Dria | |
| 2002/0096322 | A1 | 7/2002 | Barrett | |
| 2004/0118565 | A1 | 6/2004 | Crawford | |
| 2006/0054874 | A1 | 3/2006 | Oberli | |
| 2008/0272931 | A1 | 11/2008 | Auzerais | |
| 2011/0093170 | A1 * | 4/2011 | Yuet | B65H 75/425 701/50 |

FOREIGN PATENT DOCUMENTS

| | | | |
|---|---|---|---|
| WO | WO 03/089760 | A1 | 10/2003 |
| WO | 2007131662 | A1 | 11/2007 |
| WO | 2008051945 | A2 | 5/2008 |
| WO | 2009065576 | A1 | 5/2009 |

OTHER PUBLICATIONS

Written Opinion for PCT:EP2010:068035, mailed Mar. 16, 2012.
International Preliminary Report on Patentability for PCT:EP2010:068035, issued May 30, 2012.
International-Type Search Report for Application No. DK 200970223, dated Jun. 14, 2010.
Search Report for Application No. PA 2009 70223, dated Jul. 2, 2010.

* cited by examiner

APPARATUS AND SYSTEM AND METHOD OF MEASURING DATA IN A WELL EXTENDING BELOW SURFACE

TECHNICAL FIELD

The invention relates to an apparatus for measuring data in a well extending below surface. The invention further relates to a corresponding method and system.

BACKGROUND

In order to find and produce hydrocarbons e.g. petroleum oil or gas, a well may be drilled in rock (or other) formations in the Earth.

After the well bore has been drilled in the earth formation, tubulars will be introduced into the well. The tubular covering the producing or injecting part of the earth formation is called the liner. Tubulars used to ensure pressure and fluid integrity of the total well are called casing. Tubulars which bring the fluid to surface from the earth formation are called tubing. The outside diameter of the liner is smaller than the inside diameter of the well bore covering the producing or injecting section of the well, providing thereby an annular space, or annulus, between the liner and the well bore, which consists of the earth formation. Sometimes this annular space can be filled with cement or sealed off with packers preventing axial flow along the liner. However if fluids need to enter or leave the well, small holes will be made penetrating the wall of the liner and the cement in the annulus therewith allowing fluid and pressure communication between the earth formation and the well. The holes are called perforations. This design is known in the oil and natural gas industry as a cased hole completion.

An alternative way to allow fluid access from and to the earth formation can be made, a so called open hole completion. This design is used when the earth formation is deemed not to collapse with time, and then the well does not have a liner covering the earth formation where fluids are produced from or injected in to. The well designs discussed here can be applied to vertical, horizontal and/or deviated well trajectories.

To produce hydrocarbons from an oil or natural gas well, a method of maintaining reservoir pressure and sweeping hydrocarbons is via water injection or water-flooding. In water-flooding, wells may be drilled in a pattern which alternates between injector and producer wells. Water is injected into the injector wells, whereby oil in the production zone is swept or displaced into the adjacent producer wells.

Knowledge of the water injection and oil/gas production can be determined by conveying a suite of petrophysical tools in the well to gather data. This can be done in a cased hole or an open hole completion.

Conveying petrophysical tools into wells, especially horizontal wells is limited to the depth that can be reached with means of conveyance suitable for particular well dimensions, typical conveyance via coiled tubing, workstring or wireline tractor. These conveyance methods can be prevented in reaching the total depth of the well by restrictions, tortuosity, tool limits or drag, the latter two particularly seen in open hole completion.

In order to reach the total depth of these wells to fully understand production and injection, it may be advantageous to have an apparatus and system and method to convey to total depth to gather data.

SUMMARY

It is an object of the present invention to, among other things, provide the abovementioned advantage. The abovementioned advantage are achieved by a system for measuring data in a well extending below surface, said system comprising a body having a longitudinal axis and a front end and a rear end; locomotion means; control means adapted to control direction and/or speed of the locomotion means, wherein said control means are adapted to be controlled from the surface.

Thereby, the system may be conveyed into a well and controlled from the surface of the well e.g. by an operator. Additionally, the system may propel itself by the locomotion means.

Embodiments of the present invention also relates to a method corresponding to embodiments of the system.

More specifically, the invention relates to a method of measuring data in a well extending below surface with a system comprising a body having a longitudinal axis and a front end and a rear end; locomotion means; and control means adapted to control direction and/or speed of the locomotion means; wherein the method comprises controlling said control means from the surface.

The method and embodiments thereof correspond to the system and embodiments thereof and have the same advantages for the same reasons.

Embodiments of the present invention also relates to an apparatus corresponding to embodiments of the system.

More specifically, the invention relates to an apparatus to be inserted into a well extending below a surface in order to measure data in the well, said apparatus comprising a body having a longitudinal axis and a front end and a rear end; locomotion means; control means adapted to control direction and/or speed of the locomotion means; said control means comprising an optical fiber communicatively coupled to the surface; wherein the locomotion means comprises an umbrella attached to the body; and extends radially outwards from the body; and wherein a number of fluid passages are contained in the umbrella in order to substantially equate the pressure on both sides of the umbrella.

DETAILED DESCRIPTION

Figure 1:
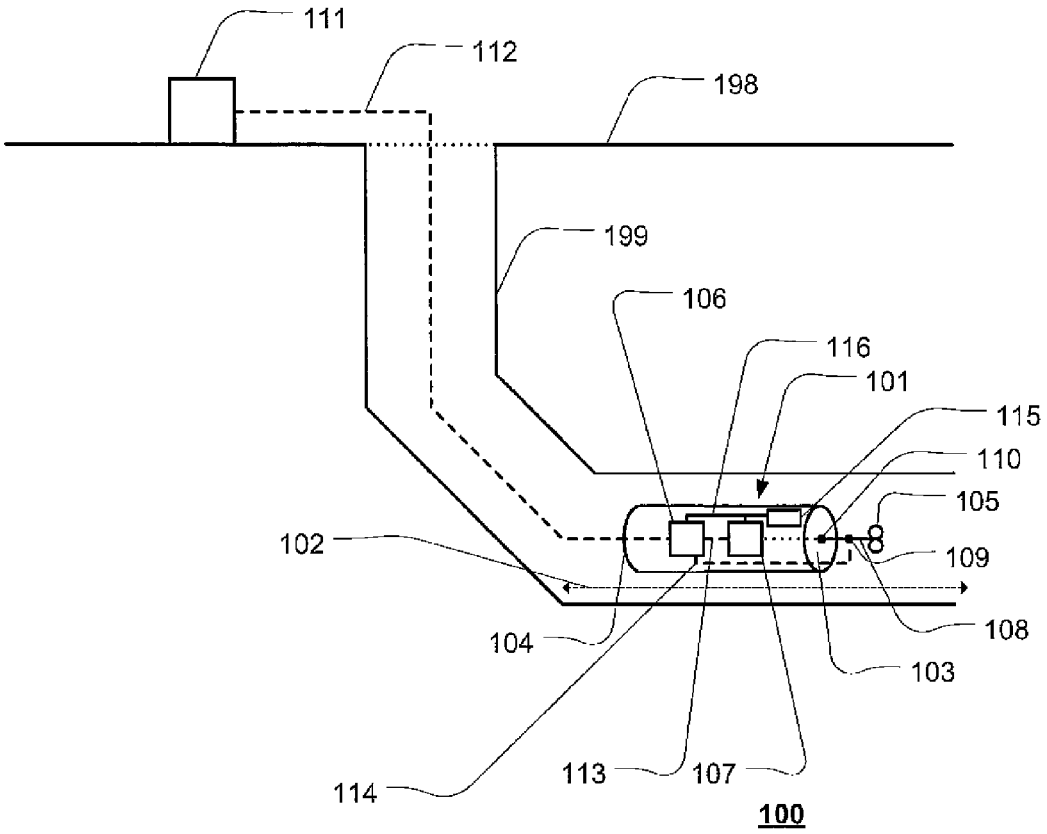
FIG. 1 shows an embodiment of a system for investigating a well extending below surface.

FIG. 1 shows an embodiment of a system 100 for measuring data in a well 199 extending below a surface 198.

In the above and below, a well may be exemplified by a borehole, an oil-well or a gas-well, a fluid-filled conduit, etc.

Additionally, above and below, the surface 198 may be exemplified by a surface of the sea, a sand surface, a rock surface, etc.

The system 100 comprises a body 101. The body 101 having a longitudinal axis 102 and a front end 103 and a rear end 104. The body 101 may be exemplified by a body of a given length and diameter e.g. 500 mm long and 90 mm in diameter. The longitudinal axis 102 may be exemplified by the axis extended along the center of the body.

The body 101 may comprise locomotion means 105. In an embodiment, the locomotion means 105 may comprise a propulsion unit such as at least one propeller/impeller and/or an umbrella as disclosed below. The propulsion unit may in an embodiment be attached to the front end of the body 101. In an embodiment, the locomotion means 105 may comprise a down-hole drive mechanism such as a well-tractor or the like adapted to deploy the body 101 in the well 199.

At least one propeller/impeller 105 may be connected to a shaft 108 via fastening means such as a screw or the like. The shaft 108 and at least one propeller/impeller may rotate with an angular velocity. The shaft 108 may be connected to driving means such as a motor 107, e.g. an electric motor, contained in the body 101 which motor 107 enables rotation of the shaft 108. The shaft 108 may enter the body 101 through an entrance hole 110 in the center of the front end 103 e.g. where the longitudinal axis 102 intersects the front end 103.

Additionally, the shaft 108 may comprise a joint 109. The joint 109 may be positioned between the entrance hole and at least one propeller/impeller 105. The joint 109 may enable directional control of the at least one propeller/impeller 105 e.g. change the angle of the shaft 105 with respect to the longitudinal axis 102. The joint may be exemplified by a knuckle joint.

The joint 108 and the motor 107 may comprise a control unit addressable via e.g. an electric wire or a circuit, which control unit may control the working of the joint 108 and the motor 107, e.g. the rotational speed of the motor 107.

Additionally, the body 101 may comprise control means 106. The control means 106 may be exemplified by e.g. an electronic circuit adapted to receive a control signal and to communicate the control signal to the locomotion means 105. Additionally, the control means 106 may be adapted to receive a measurement signal e.g. from a detector and to transmit the measurement signal to a communication unit 111.

The control means 106 may comprise a optical to electrical converter able to convert a received optical signal into an electrical signal. Further, the optical to electrical converter may be able to convert a received electrical measurement signal into an optical signal.

The control means 106 may further be communicatively coupled to the at least one propeller/impeller 105 in order to control the rotational speed of the at least one propeller/impeller 105 based on a signal received from the communication unit 111. For example, the control means 106 may be communicatively coupled to the control unit of the motor 107 via a communication link 113 e.g. via an electric wire. Thereby the control means 106 may control the speed at which the motor 107 rotates and thereby the angular velocity of the shaft 108 and the at least one propeller/impeller 105.

Additionally or alternatively, the control means 106 may control a direction of the at least one propeller/impeller 105. For example, the control means 106 may be communicatively coupled to the control unit of the joint 109 via a communication link 114 e.g. via an electric wire. Thereby the control means 106 may control the direction of the shaft and thereby the direction of the at least one propeller/impeller 105.

The body 101 may further comprise a number of power cells 115 providing power to the body 101 e.g. to the motor 107 and the control means 106 via an electric circuit 116.

The system 100 may further comprise a communication unit 111 positioned at the surface and adapted to control the control means 106 from the surface 198. The communication unit 111 may be exemplified by a computer as illustrated in FIG. 2.

The communication unit 111 may be communicatively coupled to the control means 106 of the body 101 via a wired communication link 112 e.g. an optical fiber. The communication unit 111 may transmit control signals via the optical fiber 112 in order to control the control means 106 and thus enabling control of the body 101 from the surface 198 via the optical fiber. For example, the communication unit 111 may control the direction and/or speed of the at least one propeller/impeller 105 via the optical fiber and the control means 106.

In an embodiment where the communication unit 111 is communicatively coupled to the body 101 via a fiber optic link 112, an electric wire may further be contained in the link and provide electric energy to the body via the link 112 e.g. the motor 107. Thus the number of power cells 115 may be optional in this embodiment.

Figure 2:
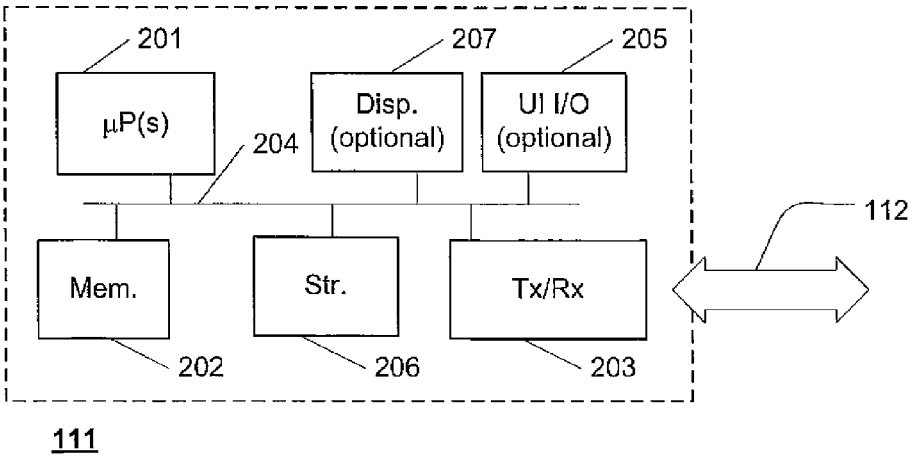
FIG. 2 shows an embodiment of a communication unit adapted to control direction and/or speed of the locomotion means.

FIG. 2 shows a computer adapted to control direction and/or speed of the locomotion means 105. Thus, FIG. 2 discloses a computer which may be utilized as the communication unit 111.

The computer 111 may comprise one or more microprocessors 201 connected with a main memory 202 and e.g. a storage device 406 via an internal data/address bus 204 or the like.

The computer 111 may further comprise communication means 203, e.g. a receiver and transmitter unit, for communication with one or more remote systems via one or more wireless and/or wired communication links 208.

The memory 202 and/or storage device 206 may store and retrieve relevant data together with executable computer code for providing the functionality according to the invention. For example, the memory 202 and storage device 206 may be used by the communication unit 111 to store received data acquired by the body through a number of sensors disclosed below and transmitted to the communication unit 111 by the control means 106.

The storage device 206 comprises one or more storage devices capable of reading and possibly writing blocks of data, e.g. a DVD, CD, optical disc, PVR, etc. player/recorder and/or a hard disk (IDE, ATA, etc.), floppy disk, smart card, PC card, USB storage device, etc.

The memory 202 may be a semiconductor type of storage device such as for example random access memory e.g. SRAM and/or DRAM, flash memory or the like.

The micro-processor(s) 201 may be responsible for generating, handling, processing, calculating, etc. the relevant parameters according to the present invention.

The computer may additionally be connected to or comprise a display 207 in order to enable an operator to receive visual information regarding the control of the body 101. Further, the communication means 203 may be exemplified by optical fiber for communicating with the control means 106. Additionally, the computer may comprise a user interface input/output unit 205 through which an operator may interact with the computer. Examples of user interface input/output units are a computer mouse and a computer keyboard.

Figure 3:
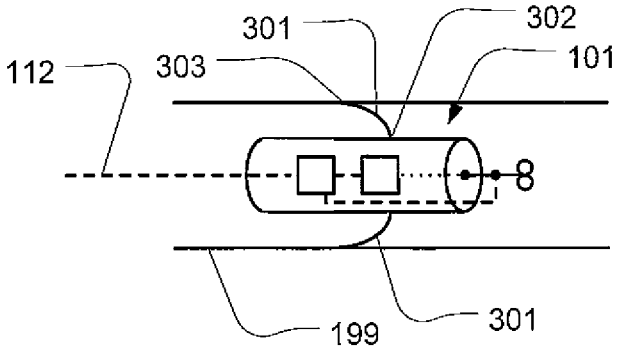
FIG. 3 shows an embodiment of the body disclosed under FIG. 1 and further comprising resilient stabilizing means.

FIG. 3 shows an embodiment of the body 101 disclosed under FIG. 1 and further comprising resilient stabilizing means 301.

The resilient stabilizing means 301 may be exemplified by a plurality of leave springs. Alternatively or additionally, the resilient stabilizing means 301 may be exemplified by a plurality of rods each rod attached to the body 101 via an elastic joint.

A first end 302 of each of the resilient stabilizing means 301 is attached to the body 101 e.g. via a fastening means such as a screw or glue or weld point elastic joint or the like. A second end 303 of each of the resilient stabilizing means 301 is in physical contact with the well 199 at least a part of the time when the body is contained in the well 199. For example, the second end 303 may be in physical contact with the well 199 permanently or only in a cased hole completion of the well or only in an open hole completion of the well. Thereby, the resilient stabilizing means is adapted to stabilize the body 101 in the well 199.

The resilient stabilizing means 301 may be directed from the front end 103 towards the rear end 104. Alternatively, the resilient stabilizing means 301 may be directed from the rear end 104 towards the front end 103. Alternatively, a first part of the resilient stabilizing means 301 may be directed from the front end 103 towards the rear end 104 and a second part of the resilient stabilizing means 301 may be directed from the rear end 104 towards the front end 103.

In an embodiment, the at least one propeller/impeller 105 may act as a power generation device instead of a propulsion device. For example, the at least one propeller/impeller 105 may be connected to a dynamo (not shown) via the shaft 108 and the dynamo may be electrically connected to the number of power cells 115. Thereby, if the at least one propeller/impeller is rotated e.g. due to a fluid flow in the well 199, then the shaft may be rotated and thus also the dynamo and thereby, electric energy may be generated which may be stored in the number of power cells 115. When the at least one propeller/impeller acts as a dynamo, the body 101 may be fastened to the well e.g. by fixating the resilient stabilizing means 301 to the sides of the well by fixating means, such as hooks or the like, attached to the second end 303 of the resilient stabilizing means 301.

Figure 4:
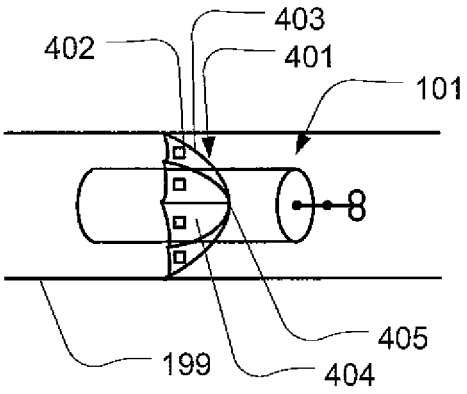
FIG. 4 shows an embodiment of the body disclosed under FIG. 1 or FIG. 3, wherein the locomotion means further comprises an umbrella.

FIG. 4 shows an embodiment of the body 101 disclosed under FIG. 1 or FIG. 3, wherein the locomotion means further comprises an umbrella 401.

The umbrella 401 may be exemplified by a plurality of resilient tubes 403 attached at one end to the body 101 and extending radially out from the body 101. Attached to the tubes 403 and extending between the tubes 403, an impermeable layer 404 such as a rubber layer or the like may be extended thereby providing an umbrella like structure.

The umbrella 401 may be attached at a first end 405 to the body 101, e.g. the front end 103 of the body 101. The umbrella 401 may extend radially out from the body 101. The umbrella 401 may in an embodiment extend out to be in physical contact with the well 199 at least a part of the time where the body 101 is contained in the well 199. Thereby, the umbrella 401 may provide propulsion if a pressure difference exist between the front and the rear of the umbrella. For example, if the pressure on the rear side 104 of the body 101 is larger than the pressure on the front side 103 of the body 101, the body 101 may be pushed into the well 199 due to the pressure difference across the umbrella 401. Additionally, if the umbrella 401 extends to be in physical contact with the well 199, the umbrella may provide a stabilizing of the body 101 in the well 199 similar to the stabilizing effect of the resilient stabilizing means 301 disclosed under FIG. 3.

In an embodiment, the umbrella 401 may comprise a number fluid passages 402 enabling a substantially pressure equalization between both sides of the umbrella 401 e.g. between the front end 103 of the body 101 and the rear end 104 of the body 101. Thus, the number of fluid passages may prevent a too high pressure to build up on one side of the umbrella 401 which could result in the umbrella 401, and thereby the body 101, becoming stuck in the well 199 due to the umbrella being pressed against the sides of the well 199 with a too large force.

The fluid passages 402 may be exemplified by a number of holes, e.g. a hole per resilient tube 403, punched in the rubber-like material 404 extended between the resilient tubes 403. Alternatively, the fluid passages may be provided by extending a rubber mesh or the like between the tubes 403 instead of an impermeable layer 404.

In an embodiment, the diameter of at least one fluid passage 402 is controllable by said communication unit 111. A controllable fluid passage 402 may be exemplified by an aperture comprising a communication unit such as an electric wire or the like. Thereby, the fluid passage 402 may be communicatively coupled to said control means 106 via the electric wire.

Therefore, the controllable fluid passage 402 may be controlled from the communication unit 111 via the control means 106 and the optical fiber 112 and the electrical wire between the control means 106 and the communication unit. Thereby is achieved that the position of the umbrella 401 with respect to the body 101 may be restored if e.g. a pressure difference between different parts of the umbrella 401 has twisted the umbrella 401 with respect to the body 101. In such a case, a fluid passage 402 may be opened in order to provide a restoring force on the umbrella 401.

Figure 5:
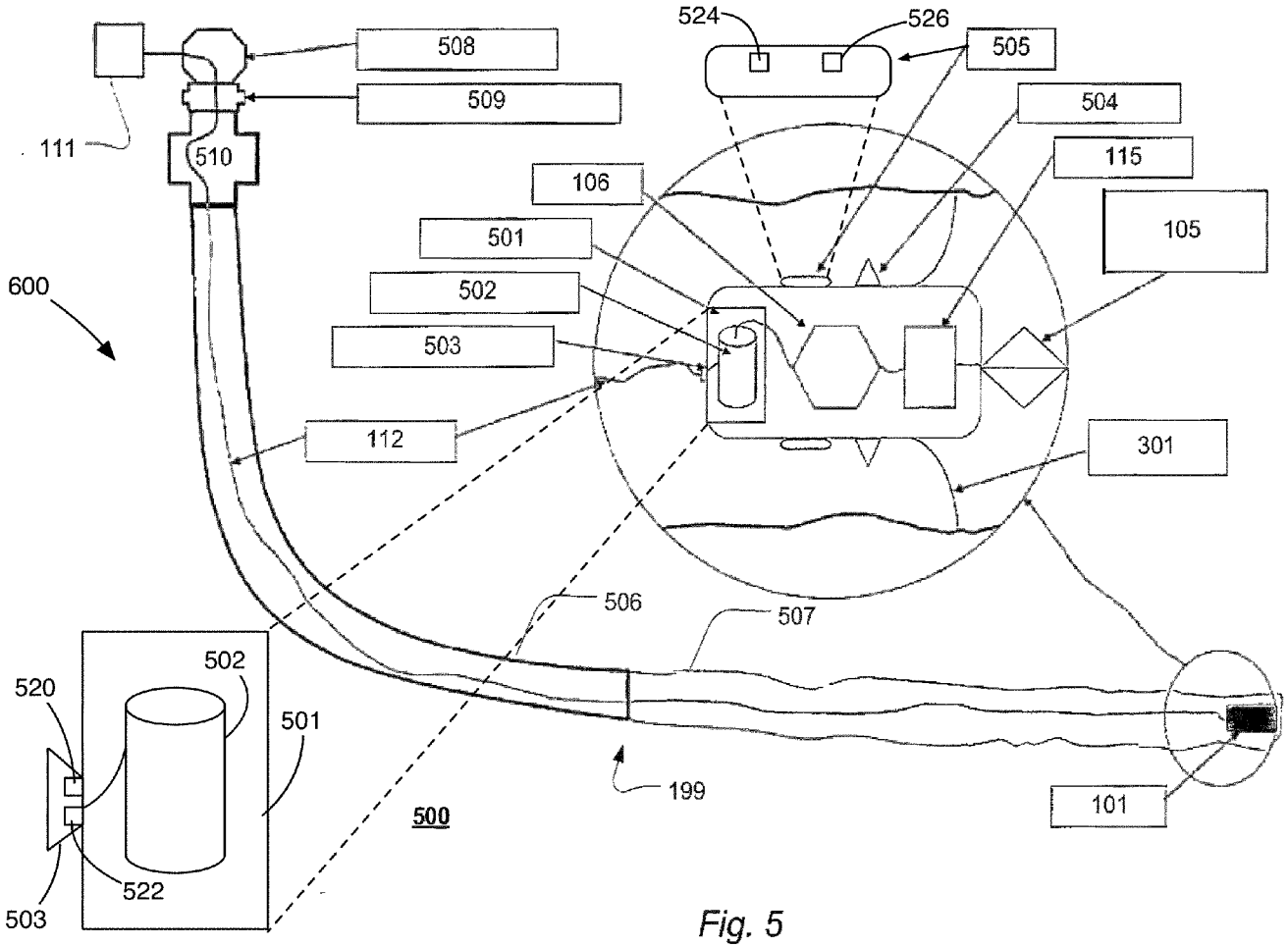
FIG. 5 shows an embodiment of the system comprising an optical fiber.

FIG. 5 shows an embodiment of the system 500 comprising an optical fiber 112.

The system 500 comprises, as the system 100 in FIG. 1, a body 101 comprising locomotion means 105, control means 106, a number of power cells 115, and an optical fiber.

Additionally, the body 101 may comprise a plurality of resilient stabilizing means 301 for stabilizing the body 101 in the well as disclosed under FIG. 3.

In the embodiment of FIG. 5, the well 199 may comprise a cased hole part 506 and an open hole part 507.

The body 101 may further comprise a number of sensors 505. The number of sensors 505 may be exemplified by a gyroscope 524, a compass, a tilt-meter 526, a pressure sensor, an ultrasonic sensor, etc.

The body 101 may additionally comprise a deployment aid 504 which may be exemplified by the umbrella 401 of FIG. 4. Further, the deployment aid 504 may comprise buoyancy means enabling the buoyancy of the body 101 to be altered and/or drive mechanism.

The body 101 may further comprise a down-hole spool device 502. The down-hole spool device 502 may be exemplified by a spool comprising a length of optical fiber e.g. 10 km Corning SMF-28 optical fiber. A first end of the optical fiber on the spool 502 may be connected to the control means 106 e.g. via an optical to electrical converter such that optical signals transmitted from the communication unit 111 to the body 101 may be converted into an electrical format which the control means 106 may handle.

The optical to electrical converter may be a two-way converter enabling conversion of electrical measurement signals from the control means 106 to optical signals which may be transmitted to the communication unit 111 via the optical fiber 112.

The spool 502 may be contained in a containment device 501 of the body 101. The containment device 501 may be exemplified by a pressurized/sealed container.

The body 101 may additionally comprise a counter and release device 503. The counter and release device 503 may be connected to the rear end 104 of the body 101 and comprise a passage through which the optical fiber 112 from the spool may pass into a fluid in the well 199.

The counter and release device 503 may further comprise means for measuring the length of optical fiber being released through the passage. The means for measuring a length of optical fiber being released may comprise a thermal tagging unit. The thermal tagging unit may comprise a heater for heating the optical fiber being released from the spool 502 and a temperature sensor 520 for measuring a temperature of a predetermined length of optical fiber being released. The faster the optical fiber is being released, the lower the temperature of the released predetermined length of optical fiber. Thereby, the speed of released may be determined and via integration, the length of fiber released.

The means for measuring a length of optical fiber released may additionally 25 or alternatively comprise a revolution counter 522 over which the optical fiber passes, and thereby, the length of optical fiber being released may be calculated from the circumference of the revolution counter multiplied by the number of revolutions.

In an embodiment, the body 101 may further determine a length travelled by the body 101 in the well 199 using a tilt-meter and/or a gyroscope being capable of measuring a direction of the body 101 and thereby enabling an ongoing measurement of a position of the body 101 and via integration, a length travelled by the body 101.

The optical fiber 112 may extend through the well 199 i.e. along the course taken by the body 101. At the surface 198 of the well i.e. at the well-head, a number of devices may be placed such as e.g. an Xmas tree (also known as a pipe tree) 510 providing entrance to the well 199, a surface well control equipment 509 enabling control of pressure and other well parameters.

Additionally, a spool device 508, e.g. a spool containing a length of optical fiber, may be connected to the well-head. The optical fiber 112 may thus be guided through the Xmas tree 510 and the surface well control equipment 509 and via the spool 508, a second end of the optical fiber 112 may be connected to the communication unit 111 e.g. via a two-way optical to electrical converter enabling the communication unit 111 to receive and transmit data as optical signals to the control means 106 via the optical fiber 112.

In an embodiment, only one spool 502 contained in the body 101 is included in the system 500. In another embodiment, only one spool 508 contained in the well-head is included in the system 500. In yet another embodiment, a spool 502 contained in the body 101 and a spool 508 contained in the well-head are included in the system 500.

Figure 6:
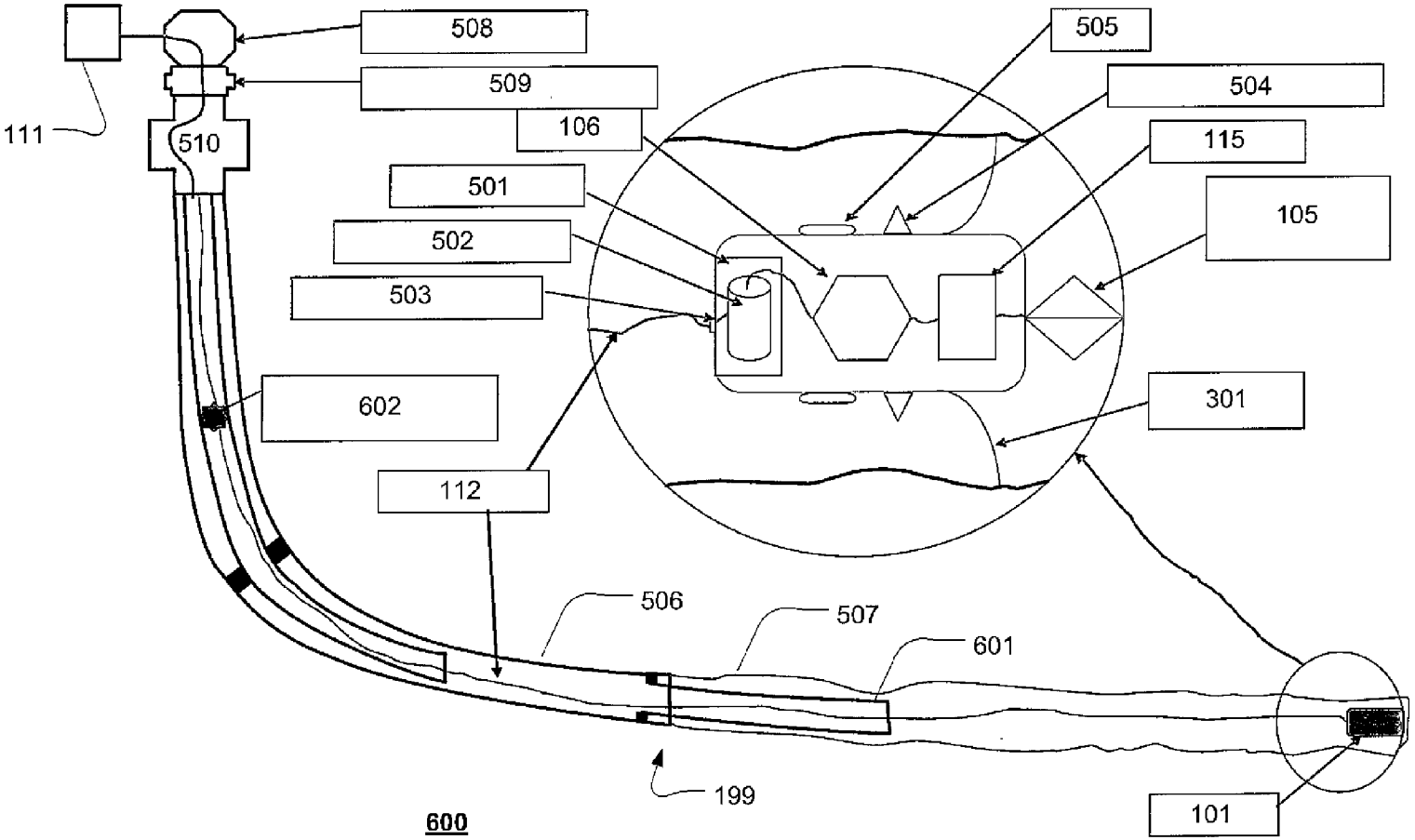
FIG. 6 shows an embodiment of the system comprising a spool in the well.

FIG. 6 shows an embodiment of the system 600 comprising a spool in the well.

The system 600 comprises the technical features of the system 500 of FIG. 5.

The well 199 in which the system 600 is embodied may comprise a liner.

Further, the system 600 may comprise an in-well spool device 602 situated between the spool device 508 connected to the well-head and the spool device 502 contained in the body 101. The in-well spool device 602 may comprise a spool comprising an optical fiber 112. One end of the optical fiber may be connected to the body 101 e.g. via the spool 502. Another end of the optical fiber may be connected to the communication device 111 e.g. via the spool 508 contained in the well-head.

In an embodiment, only one spool 502 contained in the body 101 is included in the system 600. In another embodiment, only one spool 508 contained in the well-head is included in the system 600. In yet another embodiment, only the in-well spool 602 is included in the system 600. In yet another embodiment, a spool 502 contained in the body 101 and a spool 508 contained in the well-head and an in-well spool 602 are included in the system 600. A further embodiment includes a spool 508 in the well-head and an in-well spool 602 or a spool 502 in the body 101. A further embodiment include a spool in the body 101 and an in-well spool 602.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In system claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A system for measuring data in a well extending below surface, said system comprising a body configured to be propelled down the well, the body having a longitudinal axis and a front end and a rear end;

an umbrella attached to the body which extends radially outwards from the body that includes a plurality of resilient tubes attached at one end to the body that extend radially out from the body, wherein an impermeable layer is attached to the resilient tubes and extends between the tubes, wherein a number of fluid passages are contained in the umbrella in order to substantially equalize the pressure on both sides of the umbrella;

a controller configured to control direction and/or speed of the body;

wherein said controller is configured to be controlled from the surface.

2. The system according to claim 1, further comprising an impeller attached to the front end of the body and wherein a second end of each of the plurality of resilient tubes in contact with the well at least a part of the time when the body is contained in the well such as to stabilize the system in the well; and wherein the system further comprises driving means for driving the impeller.

3. The system according to claim 1, wherein a diameter of at least one fluid passage is adapted to be controlled by said controller.

4. The system according to claim 1, wherein said controller is connected to the surface of the well via a well head.

5. The system according to claim 4, wherein the controller is connected to the well head via an optical fiber.

6. The system according to claim 5, wherein the optical fiber is contained in a spool and wherein the spool is contained in the rear end of the body.

7. The system according to claim 5, wherein the optical fiber is contained in a spool and wherein the spool is contained in the well head.

8. The system according to claim 5, wherein an end of the optical fiber is attached to a spool of the rear end of the body and another end of the optical fiber is connected to a spool positioned at the well head.

9. The system according to claim 6, wherein the system is adapted to release the optical fiber from the spool of the rear end of the body through passage means contained in the rear end of the body.

10. The system according to claim 5, wherein the system further comprises a device configured to measure a length of optical fiber being released.

11. The system according to claim 6, wherein the system further comprises a device configured to measuring a length of optical fiber being released from a spool.

12. The system according to claim 10, wherein the device comprises a thermal tagging unit.

13. The system according to claim 12, wherein the thermal tagging unit comprises a heater for heating the optical fiber and a temperature sensor for measuring a temperature of a pre-determined length of the optical fiber.

14. The system according to claims 10, wherein the device for measuring the length of optical fiber comprises a revolution counter over which the optical fiber passes and thereby measures the length and/or speed of the optical fiber being released.

15. The system according to claim 14, wherein the device for measuring the length of optical fiber further comprises a tiltmeter or a gyroscope configured to measure a direction of the body and thereby facilitating an on-going measurement of a position of the body.

16. A method of measuring data in a well extending below surface with a system comprising providing the system according to claim 1;

lowering the system into the well; and measuring data with the system.

17. An apparatus to be inserted into a well extending below surface in order to measure data in the well, said apparatus comprising a body configured to be propelled down the well, the body having a longitudinal axis and a front end and a rear end;

an umbrella attached to the body and which extends radially outwards from the body that includes a plurality of resilient tubes attached at one end to the body that extend radially out from the body, wherein an impermeable layer is attached to the resilient tubes and extends between the tubes; and wherein a number of fluid passages are contained in the umbrella in order to substantially equate the pressure on both sides of the umbrella;

a controller configured to control direction and/or speed of the body, wherein said controller comprises an optical fiber communicatively coupled to the surface.

18. The apparatus according to claim 17, further comprising an impeller and wherein a second end of each of the plurality of resilient tubes is in contact with the well at least a part of the time when the body is contained in the well such as to stabilize the system in the well; and wherein the system further comprises driving means for driving the impeller.

* * * * *